US007661937B2

(12) United States Patent
Beck

(10) Patent No.: US 7,661,937 B2
(45) Date of Patent: Feb. 16, 2010

(54) AXIAL PISTON MACHINE AND A CONTROL PLATE FOR AN AXIAL PISTON ENGINE

(75) Inventor: Josef Beck, Villingen-Schwenningen (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 632 days.

(21) Appl. No.: 10/534,178

(22) PCT Filed: Nov. 3, 2003

(86) PCT No.: PCT/EP03/12248

§ 371 (c)(1),
(2), (4) Date: May 5, 2005

(87) PCT Pub. No.: WO2004/042229

PCT Pub. Date: May 21, 2004

(65) Prior Publication Data

US 2006/0169072 A1 Aug. 3, 2006

(30) Foreign Application Priority Data

Nov. 5, 2002 (DE) ..... 102 51 552

(51) Int. Cl.
*F04B 39/10* (2006.01)

(52) U.S. Cl. ..... 417/560; 417/269; 417/454; 91/499; 92/71

(58) Field of Classification Search ..... 417/269; 91/499; 92/71
See application file for complete search history.

(56) References Cited

U.S. PATENT DOCUMENTS

| | | | | |
|---|---|---|---|---|
| 4,271,868 | A * | 6/1981 | Neff | 137/625.64 |
| 4,602,554 | A * | 7/1986 | Wagenseil et al. | 91/486 |
| 4,757,743 | A * | 7/1988 | Tovey | 91/6.5 |
| 4,920,856 | A * | 5/1990 | Berthold et al. | 91/6.5 |
| 5,807,080 | A * | 9/1998 | Ochiai et al. | 417/269 |
| 6,024,541 | A * | 2/2000 | Perstnev et al. | 417/269 |
| 6,252,321 | B1 * | 6/2001 | Fisher et al. | 310/89 |
| 6,257,767 | B1 * | 7/2001 | Borcherding et al. | 384/209 |
| 2002/0034998 | A1 * | 3/2002 | Tsunemi et al. | 475/83 |

FOREIGN PATENT DOCUMENTS

| | | |
|---|---|---|
| DE | 43 40 061 A1 | 6/1995 |
| EP | 0 686 766 | 12/1995 |

* cited by examiner

*Primary Examiner*—Devon C Kramer
*Assistant Examiner*—Dnyanesh Kasture
(74) *Attorney, Agent, or Firm*—Scully, Scott, Murphy & Presser, P.C.

(57) ABSTRACT

The invention relates to a control plate (20) for an axial piston engine (1). The inventive control plate (20) comprises a through hole (38) and a radial internal edge of said control plate (20) embodied in the form of a centering surface (29) which centers the control plate (20) to a centering body (7) arranged on the side of a bearing surface. Said centering surface (29) consists of several partial surfaces (29.1, 29.2, 29.3) formed on segments (43.1, 43.2, 43.3) of the internal edge (47) of the control plate (20) radially extending towards the internal space of said through hole (38). The segments (43.1, 43.2, 43.3) are divided by cuts (36.1, 36.2, 36.3).

17 Claims, 3 Drawing Sheets

AXIAL PISTON MACHINE AND A CONTROL PLATE FOR AN AXIAL PISTON ENGINE

The invention relates to an axial piston machine and to a control plate for an axial piston machine.

In axial piston machines, pistons which are arranged longitudinally displaceably in cylinder bores of a cylinder drum perform a stroke movement on each revolution of the cylinder drum. The movement consists of a suction stroke and a pressure stroke. In order to achieve a rotationally synchronous connection between the cylinder drum and the corresponding working line of the axial piston machine, a control plate is employed at the end side of the cylinder drum and has kidney-shaped control openings which enable the connection of the cylinder drum to a high-pressure connection and a low-pressure connection, respectively.

Such a control plate is described, for example, in DE 43 40 061 A1. The control plate has an outside diameter which corresponds to the inside diameter of the housing component. In the direction of the side facing away from the cylinder drum, the control plate is supported on a housing cover. Formed in the housing cover are a high-pressure connection and a low-pressure connection which open into corresponding control openings of the control plate. Besides the control openings, the control plate has a central cutout which is penetrated by a shaft connected to the cylinder drum in a manner fixed against relative rotation.

The disadvantage here is that the control plate is centred at its outer edge in the housing and, owing to the fact that the control plate bears with its full face on the housing cover, said plate has to be worked with a high surface quality in order to keep the losses of the axial piston machine low. Owing to the large areas to be worked in a material-removal process, the amount of material required for the raw part of the control plate is considerable. In addition, owing to the fact that the control plate is centred at its outer circumference, a large outside diameter of the control plate is required, which ultimately leads to a high component weight.

A further disadvantage is that the inevitable pressure-medium losses between the end side of the cylinder drum and the control plate, which collect inside the cylinder drum in a gap formed between the cylinder drum and the shaft, are unable to perform pressure equalisation towards the remaining leakage volume and thus an increased pressure builds up in this inner leakage volume during operation of the axial piston machine.

The object on which the invention is based is to provide an axial piston machine and a control plate for an axial piston machine in which the proportion of the material-removal processing is reduced and which has a lower component weight.

The object is achieved by the control plate according to the invention as defined in claim 1 and the axial piston machine according to the invention as defined in Claim 8.

According to the invention, the control plate is centred at its inner edge. For this, a centring surface composed of a plurality of partial surfaces is formed at the inner edge.

These partial surfaces centre the control plate on a corresponding centring body which is formed or fixed on the housing. By centring the control plate at its inner edge, the outside diameter of the control plate can be reduced. Moreover, besides the immediate reduction of the amount of material used in the raw part for making the control plate, costs are also reduced by the fact that the proportion of areas of the control plate which are to be worked is low.

The subclaims relate to advantageous developments of the control plate according to the invention and of the axial piston machine according to the invention.

In particular, it is advantageous to form the centring surface from three partial surfaces which are formed by radial extension of segments of the inner edge. The radial extension of the inner edge in the region of individual segments separated from one another is in particular of such a size here that a gap is formed between the centring body and the control plate, which gap is suitable for allowing the leakage fluid which has collected inside the cylinder drum to pass through.

Furthermore, a groove may advantageously be provided in the region of the separating areas of the control plate, on the side of the control plate facing away from the cylinder drum, or in the housing cover, which groove runs in the radial direction and thus connects the inner leakage volume to an outer leakage volume formed by the remaining housing interior space. By means of such a connection, permanent pressure equalisation between the inner leakage volume and the outer leakage volume of the axial piston machine is ensured during operation of the axial piston machine.

The control plate according to the invention and the axial piston machine according to the invention are illustrated in the drawing and explained in more detail by means of the following description. In the drawing.

Figure 1:
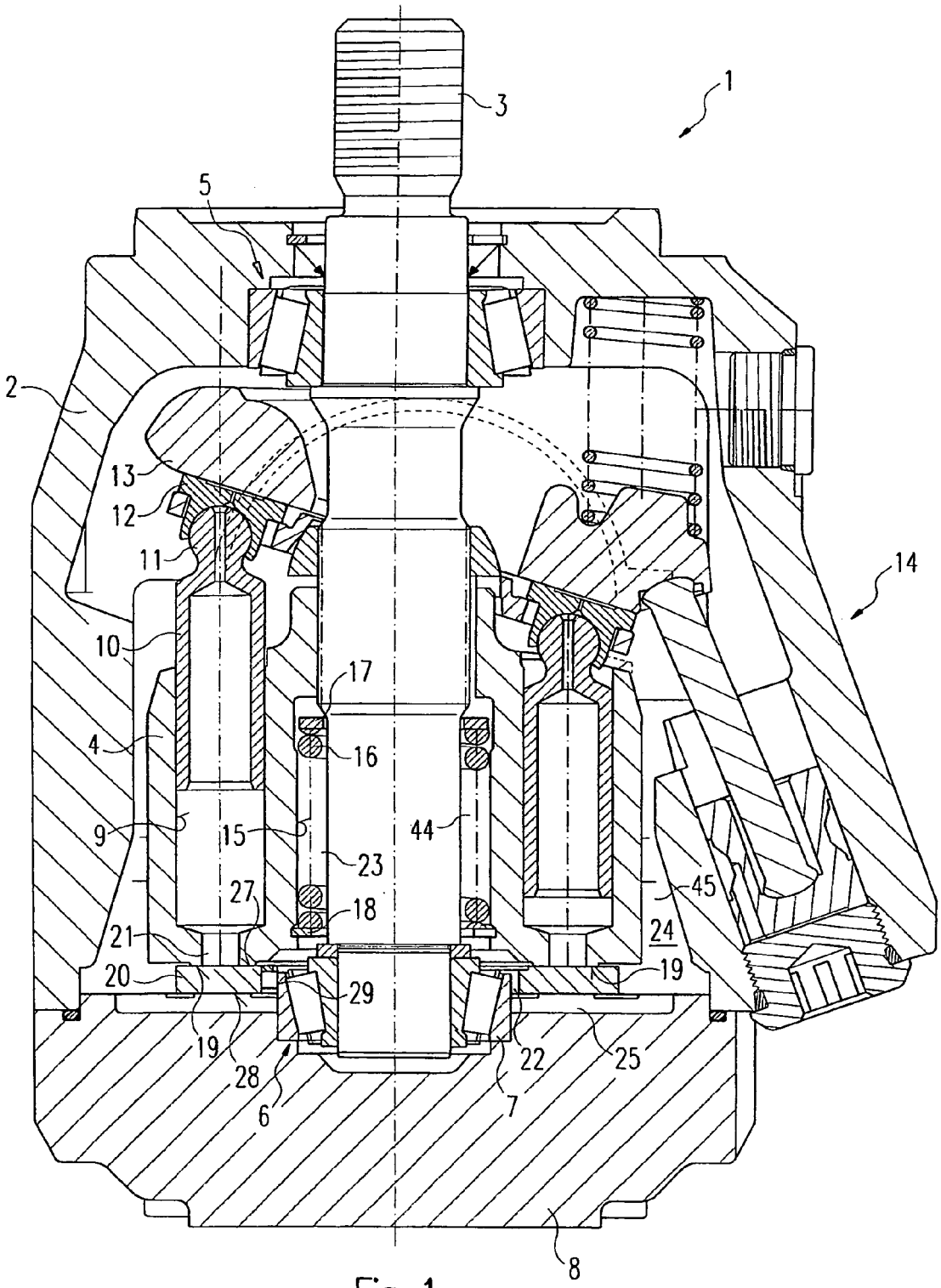
FIG. 1 shows a schematic illustration of an axial piston machine according to the invention.

Before the axial piston machine according to the invention and the control plate according to the invention are discussed in detail, the essential components of an axial piston machine and the functioning of the latter will first be explained to enable a better understanding of the invention. FIG. 1 shows an axial piston machine having a shaft 3 which is rotatably mounted in a housing 2 and on which a cylinder drum 4 is arranged, the cylinder drum 4 and the shaft 3 being connected to one another in a manner fixed against relative rotation. The shaft 3 penetrates the cylinder drum 4 and is mounted on both sides of the cylinder drum 4 in a rolling bearing 5 and 6, respectively. The rolling bearing 6 has an outer bearing race 7 which is inserted into a corresponding recess of a housing cover 8.

A plurality of cylinder bores 9 are formed in the cylinder drum 4 in a manner distributed over the circumference, the centre axes of the cylinder bores 9 running parallel to the centre axis of the shaft 3. Inserted axially displaceably in the cylinder bores 9 are pistons 10 having, on the side facing away from the housing cover 8, a spherical head 11 which cooperates with a corresponding recess of a slide shoe 12 to form a knuckle joint. The piston 10 is supported on a swash plate 13 by means of the slide shoe 12. On one revolution of the cylinder drum 4, the pistons 10 therefore perform a stroke movement in the cylinder bores 9. The length of stroke is predetermined here by the position of the swash plate 13, the position of the swash plate 13 being adjustable in the exemplary embodiment by an adjusting device 14.

The cylinder drum 4 has a central opening 15, in which there is arranged a compression spring 16 which is clamped between a first spring bearing 17 and a second spring bearing 18. The first spring bearing 17 is fixed here in the axial direction on the shaft 3, whereas the second spring bearing 18 is formed, in the exemplary embodiment illustrated, by a Seeger circlip ring inserted into a groove of the cylinder drum 4. Through the force of the compression spring 16, the cylinder drum 4 is therefore displaced in the axial direction to such an extent that its end face 19 bears sealingly on a control plate 20.

The control openings, not evident in the section of the axial piston machine 1 illustrated in FIG. 1, of the control plate 20 are, on their side facing away from the cylinder drum 4, in permanent contact with at least one high-pressure connection and one low-pressure connection, respectively. A high-pressure connection and a low-pressure connection are illustrated by way of example in FIG. 2 and provided with the reference symbols 26 and 26'. The cylinder bores 9 are open towards the end face 19 of the cylinder drum 4 via openings 21. On rotation of the cylinder drum 4, the openings 21 pass over a sealing surrounding area 27 of the control plate 20 and in the process, during one revolution, are alternately connected to the control openings of the high-pressure connection and the low-pressure connection, respectively. The end face 19 and the sealing surrounding area 27 bearing sealingly thereon may also be formed with a corresponding spherical shape.

The position of the control plate 20 is fixed by a centring surface 29 composed of a plurality of partial surfaces, as will be explained in detail below with reference to FIG. 3. The through-opening 38 of the control plate 20 has a radial extent corresponding to the outer radial extent of a centring body, the centring body being connected to a housing component. In the exemplary embodiment illustrated, the inside diameter of the through-opening, and hence the centring surface 29, corresponds to the outside diameter of the outer bearing race 7 of the rolling bearing 6 as the centring body, so that the control plate 20 is centred on the outer bearing race 7. In the axial direction, the control plate 20 is supported on the housing cover 8. To avoid leakage, the control plate 20 has a further sealing surrounding area 28 which is formed on the side of the control plate 20 facing away from the cylinder drum 4 and which cooperates sealingly with the surface of the housing cover 8.

Despite the working of the end face 19 of the cylinder drum 4 and the sealing surrounding area 27 of the control plate 20 using processes which enable a high surface quality, leakage occurs between the cylinder drum 4 and the control plate 20 and is also required in order to form a lubricating film. The central opening 15 of the cylinder drum 4 delimits an inner leakage volume 44 which receives some of the leakage oil. In order to prevent a pressure build-up in the inner leakage volume 44, which is in itself closed off, a gap 22 is formed between the control plate 20 and the outer bearing race 7 and is connected to the remaining housing volume 24 by means of a groove 25. The inner leakage volume is therefore in contact with the outer leakage volume 45 of the remaining housing volume via the gap 22 and the groove 25, allowing pressure equalisation. The leakage fluid which has collected inside the housing volume is fed back to the pressure-medium circuit in a manner not illustrated.

Figure 2:
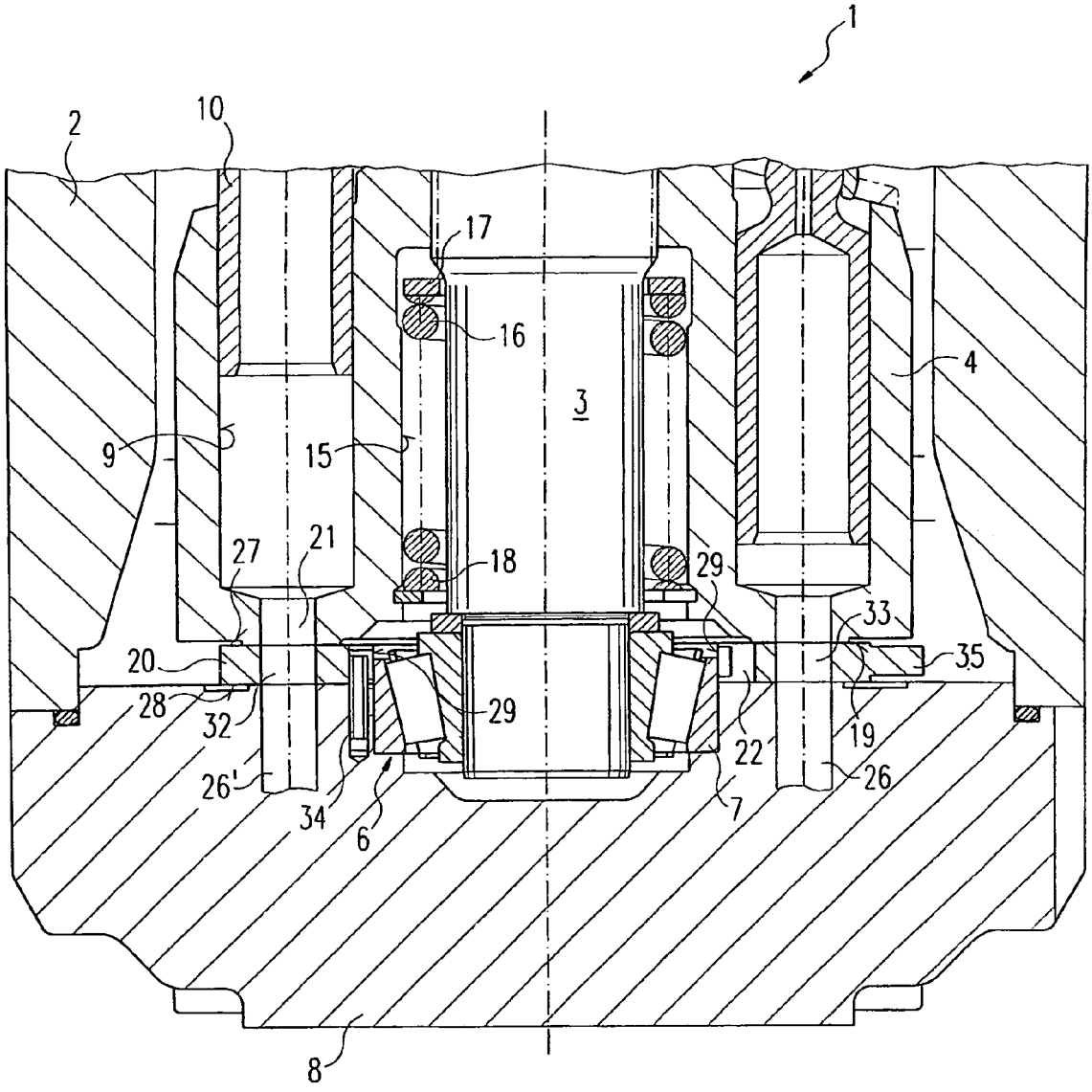
FIG. 2 shows an enlarged illustration of the region of the control plate of the axial piston machine according to the invention.

The region of the control plate 20 is illustrated once again, in enlarged fashion, in FIG. 2, with the section plane being rotated through 90° with respect to the illustration from FIG. 1. Identical components are provided with identical reference symbols. The section now runs through the control plate 20 in such a way that a first control opening 32 and a second control opening 33 are evident. For correct positioning of the control plate 20 in the radial direction, use is made of the centring surface 29, by which the control plate 20 is supported at a plurality of places on the outer circumference of the outer bearing race 7. For locking against rotation, use is made, in the exemplary embodiment illustrated, of a further dowel pin 34 which is inserted into a bore of the housing cover 8 and engages in a corresponding groove in the control plate 20.

On the high-pressure side, a radial extension 35 is formed at the outer edge 46 of the control plate 20 in order to cope with the higher mechanical stresses on the high-pressure side. The outwardly radially extended region 35 and the inner edge 47 of the control plate 20, at which edge the centring surface 29 is formed, are reduced in terms of thickness as compared with the sealing surrounding area 27 and the oppositely oriented further sealing surrounding area 28. Since the inner edge 47 of the control plate 20 and the radial extension 35 are subject to only modest surface-quality requirements at their surfaces oriented towards the cylinder drum 4 and towards the housing cover 8, further working of the rough part can be largely dispensed with in this region. By contrast, in the region of the sealing surrounding area 27 and the oppositely oriented further sealing surrounding area 28, the rough part of the control plate 20 undergoes appropriate further working, in which a high surface quality and evenness is achieved, for example by lapping.

Figure 3:
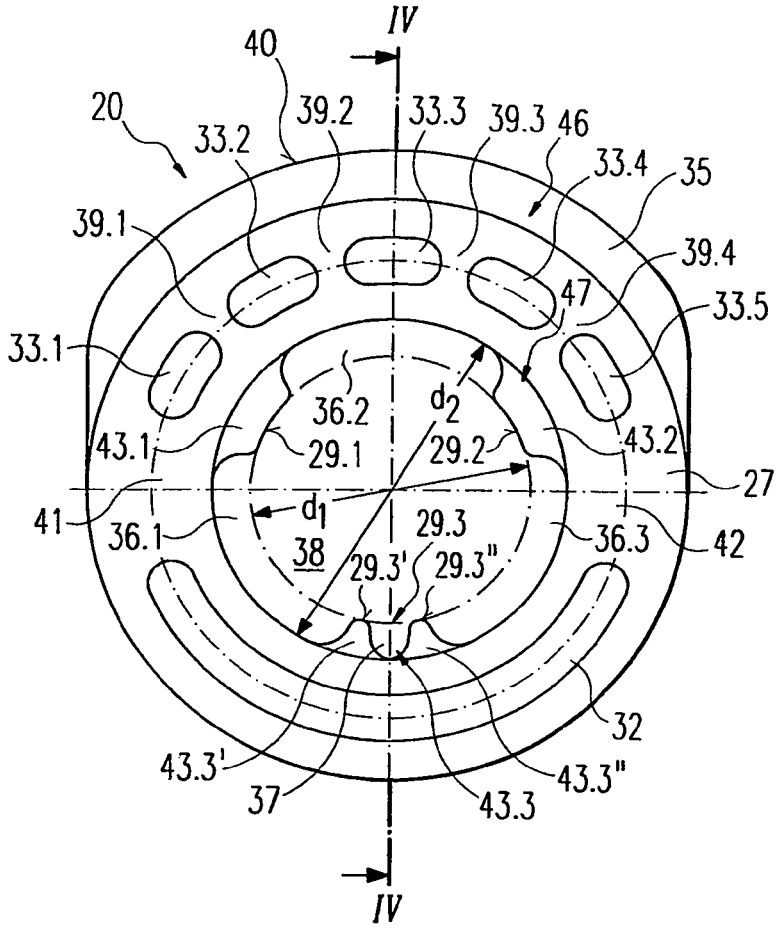
FIG. 3 shows a plan view of a control plate according to the invention.

An example of a constructional embodiment of a control plate 20 is illustrated in FIG. 3. The control plate 20 has a substantially circular geometry. Formed in the centre of the control plate 20 is a through-opening 38 having a diameter $d_1$. The inner edge 47 of this through-opening 38 forms the centring surface 29. The through-opening 38 is inwardly extended in the radial direction at individual recesses 36.1, 36.2, 36.3. Between each of the recesses 36.1 to 36.3 there remains a segment 43.1, 43.2 and 43.3 with an inside diameter $d_1$. This results in three partial surfaces 29.1, 29.2 and 29.3, as the centring surface 29, on the segments 43.1, 43.2 and 43.3. The third partial surface 29.3 is once again subdivided, in the preferred exemplary embodiment, by making a recess 37 therein, so that the third partial surface 29.3 is composed of the two partial surfaces denoted by 29.3' and 29.3". Accordingly, the third segment 43.3 is composed of the two partial segments 43.3' and 43.3". The recess 37 is provided in order to receive the dowel pin 34, so that the control openings 32 and 33.1 to 33.5, respectively, have a defined position.

In the exemplary embodiment illustrated, the recesses 36.1, 36.2 and 36.3 are arranged in a manner distributed uniformly over the circumference of the through-opening 38. Their radial extension extends up to a diameter $d_2$ which is large enough to form, with respect to the outer bearing race 7, the gap 22 through which a leakage fluid can pass.

The control plate 20 furthermore has the kidney-shaped low-pressure control opening 32, via which the openings 21 of the cylinder drum 4 are connected to the low-pressure connection. To connect the openings 21 to a high-pressure connection, in the exemplary embodiment illustrated there are provided a plurality of likewise kidney-shaped high-pressure control openings, which are denoted by the reference symbols 33.1 to 33.5. The respectively adjacent high-pressure control openings 33.1 to 33.5 are separated from one another by a separating web 39.1 to 39.4. Formed between the control openings 32 and 33.1 to 33.5 are separating areas 41 and 42 which, when the control plate 20 is installed, close the openings 21 in the region of the top and bottom dead centre, as illustrated in FIG. 1.

While the extent of the control plate 20 in the radial direction in the region of the low-pressure control opening 32 is only slightly greater than the radial extent of the control opening 32 itself, in the region of the high-pressure control openings 33.1 to 33.5 a radial extension 35 is additionally formed. The radial extension 35 has an outer edge 40 which runs in the shape of a circular arc and which is formed concentrically with respect to the circular-disc-shaped geometry of the control plate 20.

The control plate 20 is produced from a rough part which is preferably manufactured in a hot-forging process. The rough part here is of lower thickness in the region of the radial extension 35 and in the region between the diameters $d_1$ and $d_2$ than in the sealing region 27 and 28. The formation of the radial enlargement of the recesses 36.1, 36.2 and 36.3 is carried out during the actual hot-forging process or by material-removal working, as is the formation of the recess 37 for the further dowel pin 34. By contrast, the control openings 32 and 33.1 to 33.5, respectively, are preferably punched, it being possible for the punching to be carried out in the warm or cold state. Finally, the sealing surrounding areas 27 and 28 are worked, for example by lapping.

Figure 4:
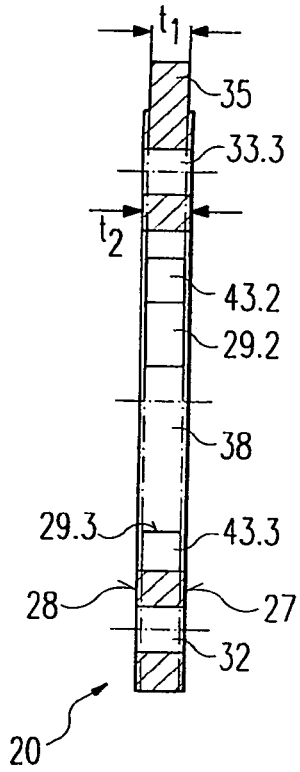
FIG. 4 shows a section of a control plate according to the invention.

In FIG. 4, a section through the control plate 20 along the line IV-IV in FIG. 3 is shown. In the sectional illustration, it is once again evident that in the region of the sealing surrounding area 27 and the further sealing surrounding area 28 of the control openings 32 and 33 a greater thickness $t_2$ of the control plate 20 is provided as compared with the thickness $t_1$ in the region of the radial extension 35 and the centring surface 29 or the radial segments 43.1 to 43.3, the thickness variation occurring preferably on both sides of the control plate 20. By reducing the thickness in partial regions of the control plate 20 and by reducing the outside diameter of the control plate 20 as compared with conventional control plates, a considerable reduction of the total weight is possible. Moreover, by reducing the thickness $t_1$ of the control plate 20 in those regions which have no sealing function, the proportion of material-removal working is reduced from about 50% to about 20%. Besides lowering costs by reducing the amount of material used, a further advantage which results is that of shortening of the working time.

The invention claimed is:

1. A control plate for an axial piston machine having a generally kidney-shaped low-pressure control opening and at least one generally kidney-shaped high-pressure control opening that is opposed to the low-pressure control opening, by means of which cylinder bores of a cylinder drum rotatably mounted in a housing are alternately connected, on rotation of the cylinder drum, to a high-pressure connection and a low-pressure connection, a through-opening being formed in the control plate, wherein:

a radially inner edge of the control plate is designed as a centering surface which centers the control plate on a centering body on the housing;

in that the centering surface is composed of a plurality of partial surfaces formed on segments of the inner edge of the control plate which extend radially inwardly into the through-opening and are separated by recesses; and wherein a radial extension of the control plate is formed at an outer edge of the control plate only in the region of the entirety of the at least one high-pressure control opening that is connected to the high-pressure connection, and the radial extension of the control plate is formed over the entire region of the entirety of the at least one high-pressure control opening that is connected to the high-pressure connection.

2. The control plate according to claim 1, wherein the centering surface is composed of three partial surfaces distributed over the circumference of the inner edge of the control plate.

3. The control plate according to claim 1, wherein the thickness ($t_1$) of the control plate is reduced in the region of the centering surface and/or the radial extension as compared with the thickness ($t_2$) of a sealing surrounding area of the control openings.

4. The control plate according to claim 1, wherein a further recess is provided at the centering surface in order to receive a rotation-locking element.

5. An axial piston machine having a cylinder drum which is rotatably mounted in a housing and in which are formed cylinder bores in which pistons are axially displaceably arranged, and having a centering body connected to the housing, the cylinder bores having openings towards an end side of the cylinder drum, which, on rotation of the cylinder drum, are alternately in connection with a high-pressure connection and low-pressure connection via a generally kidney-shaped low-pressure control opening and at least one generally kidney-shaped high-pressure control opening that is opposed to the low-pressure control opening of a control plate, the control plate having through-opening, wherein a radially inner edge of the control plate is designed as a centering surface which centers the control plate on a centering body formed on the housing and in that the centering surface is composed of a plurality of partial surfaces formed on segments of the inner edge of the control plate which extend radially inwardly into the through-opening and we separated by recesses, and wherein an outer radial extension of the control plate is formed at an outer edge of the control plate only in the region of the entirety of the at least one control opening that is connected to the high-pressure connection and the radial extension of the control plate is formed over the entire region of the entirety of the at least one high-pressure control opening that is connected to the high-pressure connection.

6. The axial piston machine according to claim 5, wherein the centering surface is composed of three partial surfaces distributed over the circumference of the inner edge of the control plate.

7. The axial piston machine according to claim 5, wherein the cylinder drum is arranged on a shaft in a manner fixed against relative rotation, the shaft being mounted in the housing on the side of the control plate, and the control plate being centered on an outer bearing race of a rolling bearing by the centering surface.

8. The axial piston machine according to claim 5, wherein at least one groove is provided in the region of a separating area on the side of the control plate facing away from the cylinder drum, which groove runs from at least one of the recesses of the inner edge of the control plate to the outer edge of the control plate and connects an inner leakage volume to an outer leakage volume.

9. The axial piston machine according to claim 5, wherein the end side of the cylinder drum and a sealing surrounding area, bearing thereon, of the control plate are essentially disk-shaped.

10. A control plate for an axial piston machine having at least two control openings, by means of which cylinder bores of a cylinder drum rotatably mounted in a housing are alternately connected, on rotation of the cylinder drum, to a high-pressure connection and a low-pressure connection, a through-opening being formed in the control plate, wherein:

a radially inner edge of the control plate is designed as a centering surface which centers the control plate on a centering body on the housing:

the centering surface being composed of three partial surfaces formed on three segments of the inner edge of the control plate which extend radially inwardly into the through-opening, the segments being separated by three equally spaced recesses and within one said segment being provided a further smaller recess at the centering surface in order to receive a rotation-locking element.

11. The control plate according to claim 10, wherein the thickness ($t_1$) of the control plate is reduced in the region of the centering surface and/or the radial extension as compared with the thickness ($t_2$) of a sealing surrounding area of the control openings.

12. The control plate according to claim 10, wherein the radial extension of the control plate is formed at an outer edge of the control plate in the region of the at least one control opening connected to the high-pressure connection.

13. An axial position machine having a cylinder drum which is rotatably mounted in a housing and in which are formed cylinder bores in which pistons are axially displaceably arranged, and having a centering body connected to the housing, the cylinder bores having openings towards an end side of the cylinder drum, which, on rotation of the cylinder drum, are alternately in connection with a high-pressure connection and low-pressure connection via at least two control openings of a control plate, the control plate having a through-opening, wherein a radially inner edge of the control plate is designed as a centering surface which centers the control plate on a centering body formed on the housing and;

in that the centering surface is composed of three partial surfaces formed on three segments of the timer edge of the control plate which extend radially inwardly into the through-opening, the segments being separated by three equal recesses and within one segment being provided a further smaller recess at the centering surface in order to receive a rotation-locking element.

14. The axial piston machine according to claim 13, wherein the cylinder drum is arranged on a shaft so as to be fixed against relative rotation, the shaft being mounted in the housing on the side of the control plate, and the control plate being centered on an outer bearing race of a rolling bearing by the centering surface.

15. The axial piston machine according to claim 13, wherein at least one groove is provided in the region of a separating area on the side of the control plate facing away from the cylinder drum, which groove runs from at least one of the recesses of the inner edge of the control plate to the outer edge of the control plate and connects an inner leakage volume to an outer leakage volume.

16. The axial piston machine according to claim 13, wherein the end side of the cylinder drum, and a sealing surrounding area, bearing thereon, of the control plate are essentially disk-shaped.

17. The axial piston machine according to claim 13, wherein an outer radial extension of the control plate is formed at an outer edge of the control plate in the region of the at least one control opening connected to the high-pressure connection.

* * * * *